US005128877A

United States Patent [19]

Tang

[11] Patent Number: 5,128,877

[45] Date of Patent: Jul. 7, 1992

[54] METHOD OF DRAW FORMING ANALYTICALLY DETERMINED BINDER WRAP BLANK SHAPE

[75] Inventor: Sing C. Tang, Plymouth, Mich.

[73] Assignee: Ford Motor Company, Dearborn, Mich.

[21] Appl. No.: 535,255

[22] Filed: Jun. 8, 1990

[51] Int. Cl.[5] ..... G06F 15/46; B21D 5/02

[52] U.S. Cl. ..... 364/476; 364/472; 72/347; 29/897.2; 29/34 R

[58] Field of Search ..... 364/472, 476, 474.07; 72/347, 389; 29/163.6, 897.2, 897.32, 33.5, 34 R, DIG. 11

[56] References Cited

U.S. PATENT DOCUMENTS

| | | | |
|---|---|---|---|
| 4,016,742 | 4/1977 | Shiokawa | 72/465 |
| 4,486,841 | 12/1984 | Koyama et al. | 364/474.07 |
| 4,698,991 | 10/1987 | Kirii et al. | 264/476 |

OTHER PUBLICATIONS

"Evaluation Methods of Press Forming Severity in CAD Applications", Takahashi et al, Computer Modeling of Sheet Forming Process, Edit by Nang C. Tang, The Metallurgical Soc., pp. 37-50, 1985.

*Primary Examiner*—Jerry Smith

*Assistant Examiner*—Paul Gordon

*Attorney, Agent, or Firm*—Joseph W. Malleck; Roger L. May

[57] ABSTRACT

Method of rapidly determining a binder wrap for a nonsymmetrical polygonal panel to be drawn formed, comprising: (a) forming a coordinate-based model of the blank outline of said panel; (b) specifying the displacement boundary condition of the binder wrap by nonlinear theory of mechanics, including: (i) defining arc sets to fit projections of opposite sides of the blank outline, having the greatest curvature, onto arc planes while incrementally bending the panel from a known flat condition to a binder surface condition and controlling each arc set to pass through a fixed point as it is changed in radius, (ii) interpolating from said arc sets to generate points on the unprojected opposite sides having such greatest curvature and thus defining the binder surface for the blank outline along such sides, (iii) defining the binder surface for the blank outline along sides having the least curvature by forcing such sides to lie on the binder surface through the act of proportionally reducing the gap or interference during the bending process in step (b)(i); and (c) determining the deformed shape of the panel suspended inside the punch opening line.

8 Claims, 7 Drawing Sheets

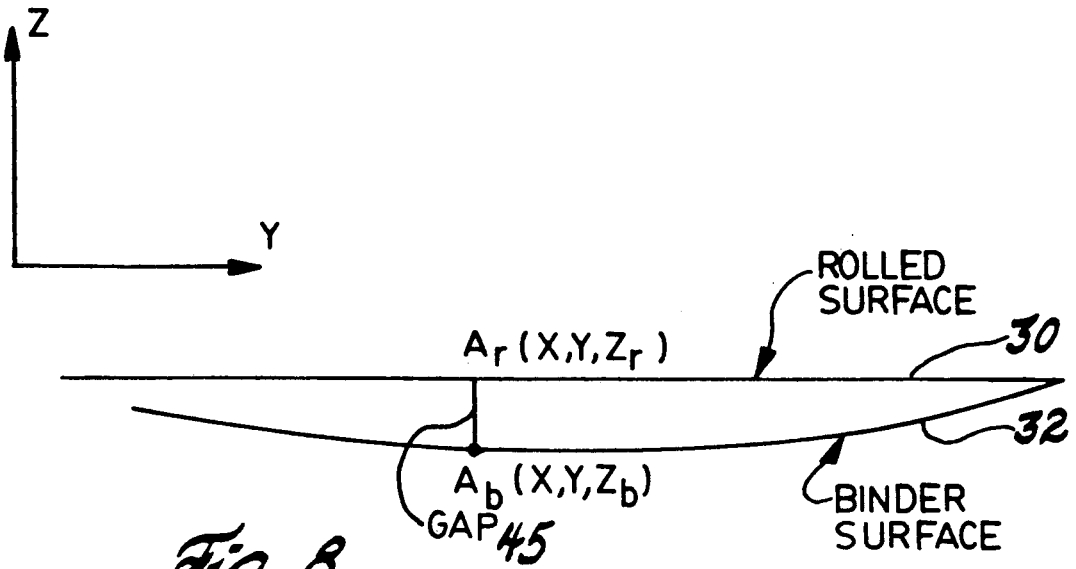
Fig. 8
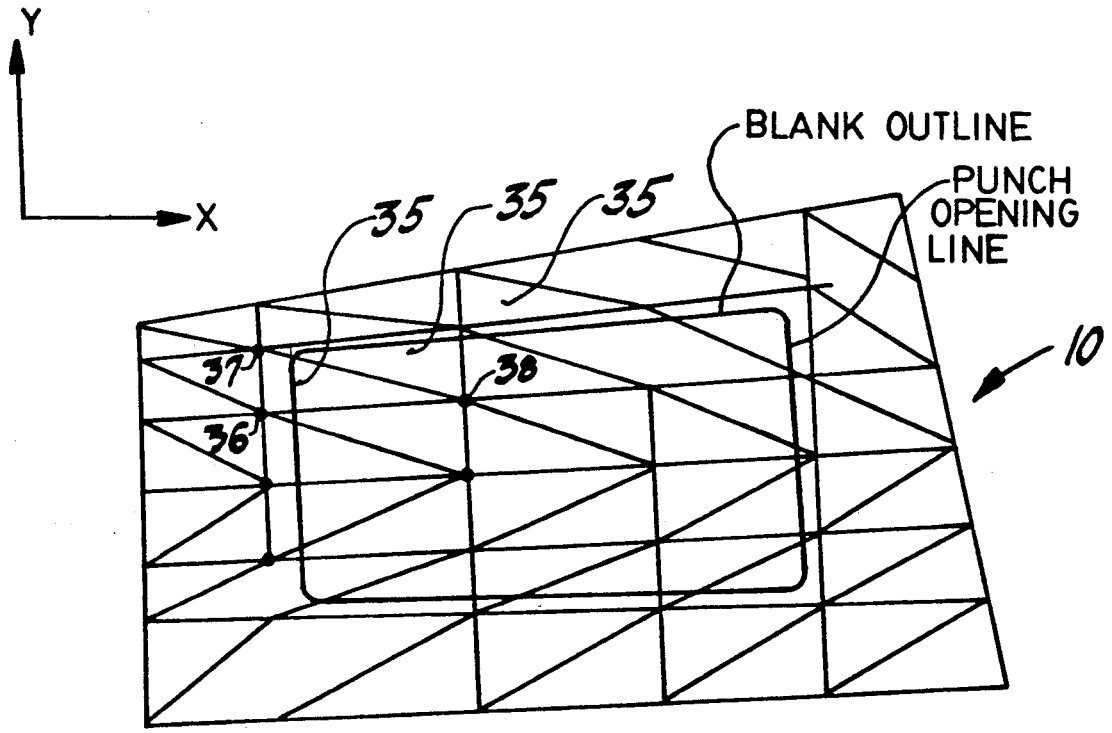
Fig. 9
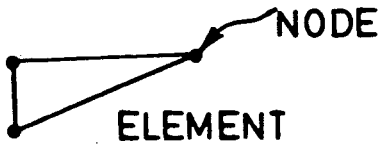

METHOD OF DRAW FORMING ANALYTICALLY DETERMINED BINDER WRAP BLANK SHAPE

BACKGROUND OF THE INVENTION

1. Technical Field

This invention relates to the art of draw forming metals, and more particularly to determining the change in shape of a metal sheet during binder closure and before draw punch impact.

2. Discussion of the Prior Art

In a draw forming process of sheet metal there are two stages: (1) the binder wrap (preforming stage), and (2) the punch and die contact stage. The sheet blank is gripped peripherally by the binder ring, which ring may have large curvatures deviating from a flat plane along two or more edges. In stage one, the sheet is laid on the lower binder surface of a die and the upper binder ring comes down to set the binder shape, called the binder wrap. In stage two, the punch travels down through the upper binder ring to form a contoured panel shape. In the punch stage, the sheet is drawn between the binder ring and die and feeds into the interior shape to accommodate deep draw of the latter.

It is necessary to compute the binder wrap configuration of a sheet to be able to determine, with further analysis, the punch and die closure in the second stage. The interior, ungripped portion of the sheet blank is virtually suspended; its deformed shape will be complex as a result of the weight of the sheet and as a result of the forced peripheral curvatures.

Sheet metal draw blanks which are not initially contacted by the draw punch in a centralized location of the suspended portion of the blank are likely to form wrinkles in the blank when fully drawn. In order to design the punch to contact the blank in such a centralized location for any particular application, the deformed shape of the blank must be known or determined as it is gripped in the binder wrap stage to permit punch/die redesign.

The prior art has heretofore used essentially three teachings: (i) a trial and error method of making binders and punches/dies, followed by rework and redesign until the desired shape is obtained; (ii) a geometric method based on fitted surface projections of the closest geometrical shape at each segment of the binder ring shape; and (iii) prediction of the binder wrap using a linear theory where the sheet deflection is assumed proportional to the applied load (a standard finite element program, such as NASTRAN, is commercially available to carry out the linear theory). The first method is too expensive and time consuming, the second method is too simplistic, leading to poor quality of draws because the mechanical properties, thickness and friction characteristics of the metal are not considered, thus requiring costly tryouts to compensate for inaccuracies. The last method is classic linear theory and is not valid to compute large deflections. An article representing the use of the last method is Takahashi et al, "Evaluation Methods of Press Forming Severity in CAD Applications", Computer Modeling of Sheet Forming Process, Edit by Nang C. Tang, The Metallurgical Soc, pp. 37-50, 1985.

SUMMARY OF THE INVENTION

The invention is a method of rapidly and accurately determining binder wrap for a nonsymmetrical polygonal panel to be draw formed. The method comprises essentially three steps: (a) forming a coordinate-based model of the blank outline of the panel; (b) specifying the displacement boundary condition of the binder wrap by nonlinear theory of mechanics, including: (i) defining arc sets to fit projections of opposite sides of the blank outline, having the greatest curvature, onto arc planes while incrementally binding the panel from a known flat condition to a binder surface condition and controlling each arc set to pass through a fixed point as it is changed in radius, (ii) interpolating from said arc sets to generate points on the unprojected opposite sides having such greatest curvature and thus defining the binder surface for the blank outline along such sides, (iii) defining the binder surface for the blank outline along sides having the least curvature by forcing such sides to lie on the binder surface through the act of proportionally reducing the gap or interference during the bending process in step (b)(i); and (c) determining the deformed shape of the panel suspended inside the punch opening line.

Blank outline is used herein to mean the periphery of a panel; punch opening line is used herein to mean the boundary of a hole through which the punch travels; arc set is used herein to mean a composite of straight line and circular arc segments that conform to a complete projected panel side.

Preferably, the incremental bending of step (b)(i) is limited to a vertical displacement at a point of no greater than two inches for an automobile body panel to obtain convergence of the step-wise linearized solution.

Preferably, the determination of the deformed shape of the suspended panel in step (c) is carried out by determining the displacement increment at nodes of segments of the blank outline into which the suspended panel portion is divided, and more particularly by specifying the above-mentioned incremental displacement boundary conditions on all sides of a panel and specifying the incremental force due to the panel weight, a boundary value problem can be formulated and solved to obtain the displacement increments for the portion of the panel inside of the punch opening. The formulation may be a ratio of the external force at each of such nodes (proportional to vertical displacement) to the tangent stiffness (strain) at each such node.

Preferably, an additional step is added to the process wherein after steps (a)-(c) there is an adjustment of all sides of the panel so that the panel portion lying outside of the punch opening line is on the binder surface of a die and any added deformation of the suspended panel portion in conforming with such adjustment is made.

SUMMARY OF THE INVENTION

FIG. 8 is a schematic representation of the binder surface for the blank outline along the sides having the least curvature; such sides are forced to lie on the binder surface by proportionally reducing the gap during the bending process; and FIG. 9 is a plan view of the panel model subdivided into triangular shapes for use in determining the deformed shape of the panel suspended within the punch opening line.

DETAILED DESCRIPTION AND BEST MODE

In a draw forming process of sheet metal there are essentially two stages: (1) the binder wrap (preforming), and (2) the punch and die contact. In the second stage, a surface contact problem with friction must be solved to ensure accurate draw forming results.

Figure 1:
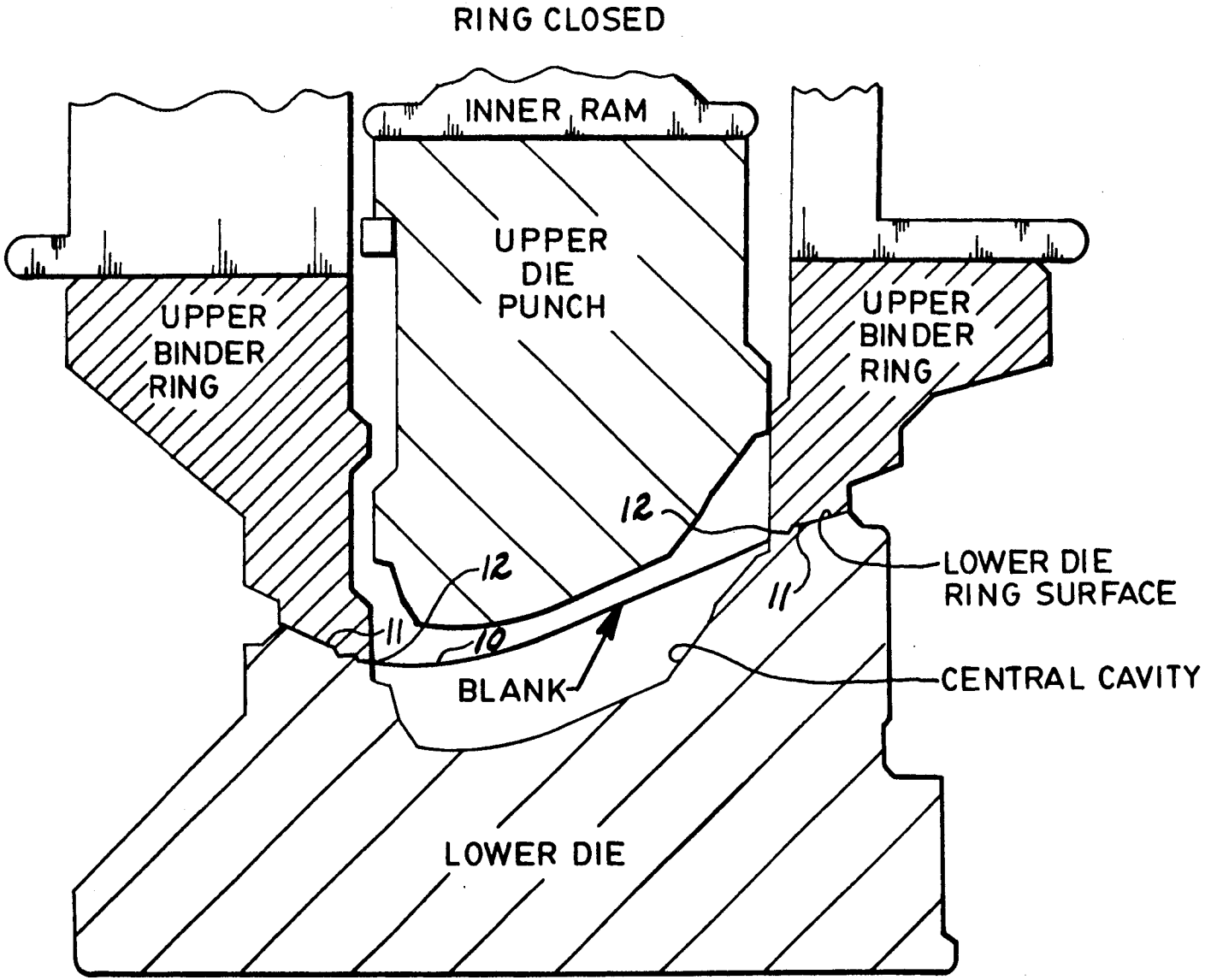
FIGS. 1-2 are sectional views of a deep draw press apparatus for an automotive body panel, FIG. 2 illustrating the upper punch die in its inactive state, and FIG. 3 representing the punch die in its active position lowered into the bottom cavity.
Figure 2:
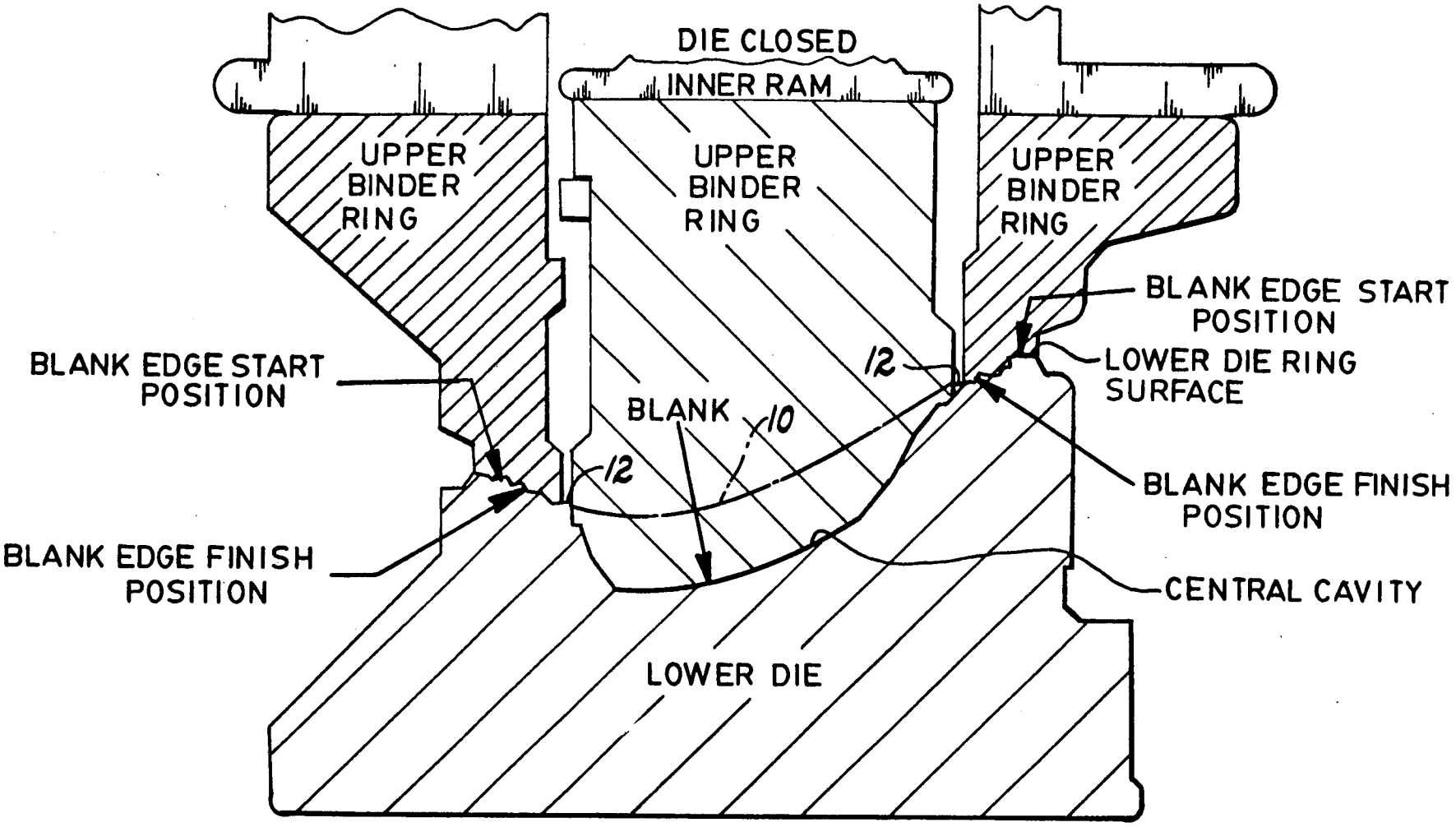

As shown in FIGS. 1 and 2, the lower die is formed not only to provide the central cavity into which the sheet metal blank 10 is draw formed, but also has a ring surface against which the upper binder ring is lowered into contact prior to the draw form stage. To ensure that wrinkles do not occur in the interior suspended panel portion after draw forming, the binder wrapped peripheral portion of the sheet metal must be made properly. Certainly, the inner periphery of such binder ring must conform with the desired ultimate Periphery of the body panel to be formed, but also preformed to avoid wrinkling as the panel is drawn into the cavity from the binder wrapped surfaces. The contours and shape of the suspended portion must be known in advance prior to the draw forming operation so that the upper die punch is restricted to initially contact the suspended panel portion at a central location first. Knowledge of the exact suspended shape of the inner panel portion is critical to knowing whether any off-center contact will be made between the upper die and the suspended portion. With such prior knowledge, adjustments can be made to the slope of the binder surface to allow the suspended panel portion to be contacted by the upper die at a central location.

Figure 3:
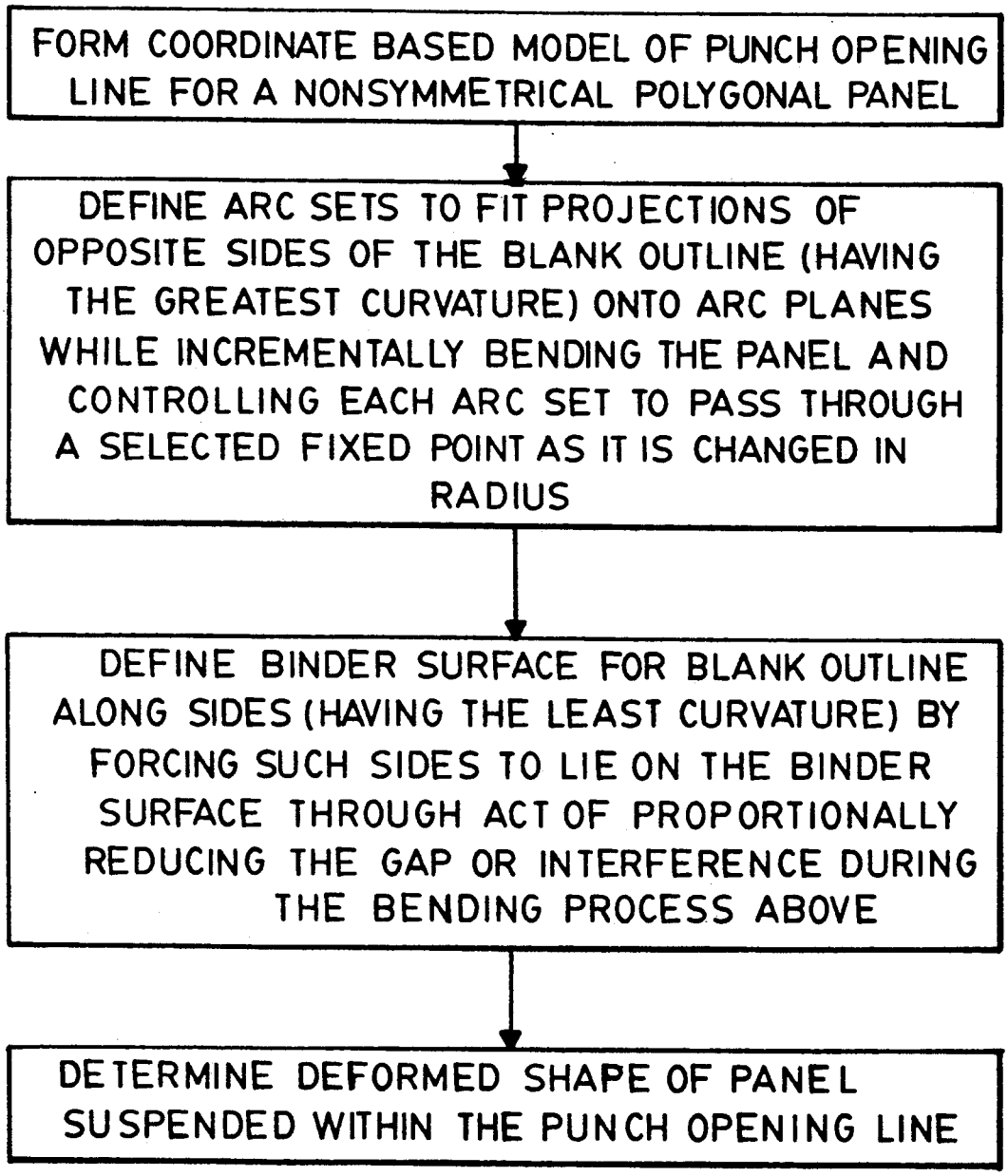
FIG. 3 is a block diagram of the abbreviated process steps of this invention.
Figure 4:
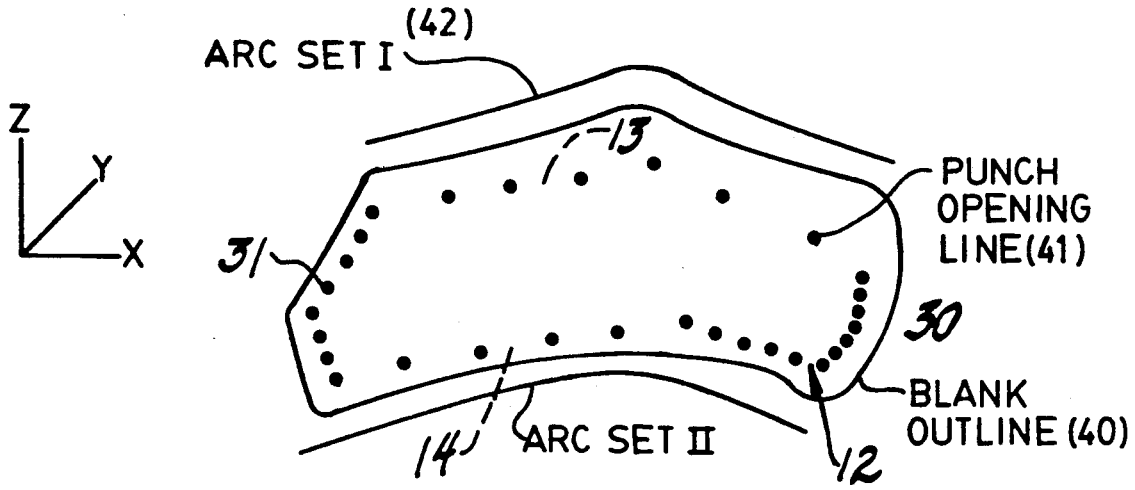
FIG. 4 is a schematic representation of one example of a coordinate based model utilized for the first step of this inventive process.

Basic steps of the process are illustrated in FIG. 3 in block diagram form. In the first block of the process, a coordinate-based model of a blank outline and punch opening line is formed, such outline being for a nonsymmetrical polygonal panel. Such coordinate-based model (such as illustrated in FIG. 4) is formed by input point data to generate a blank outline 40 and a punch opening line 41.

Figure 6:
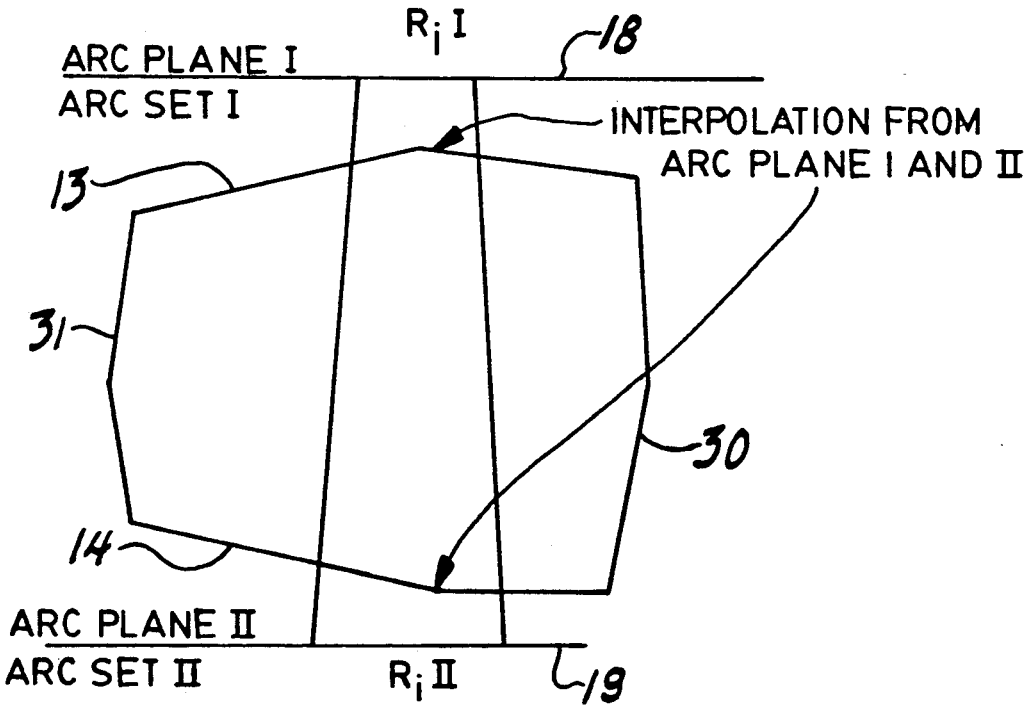
FIG. 6 is a plan view of the coordinate based model of FIG. 4.
Figure 5:
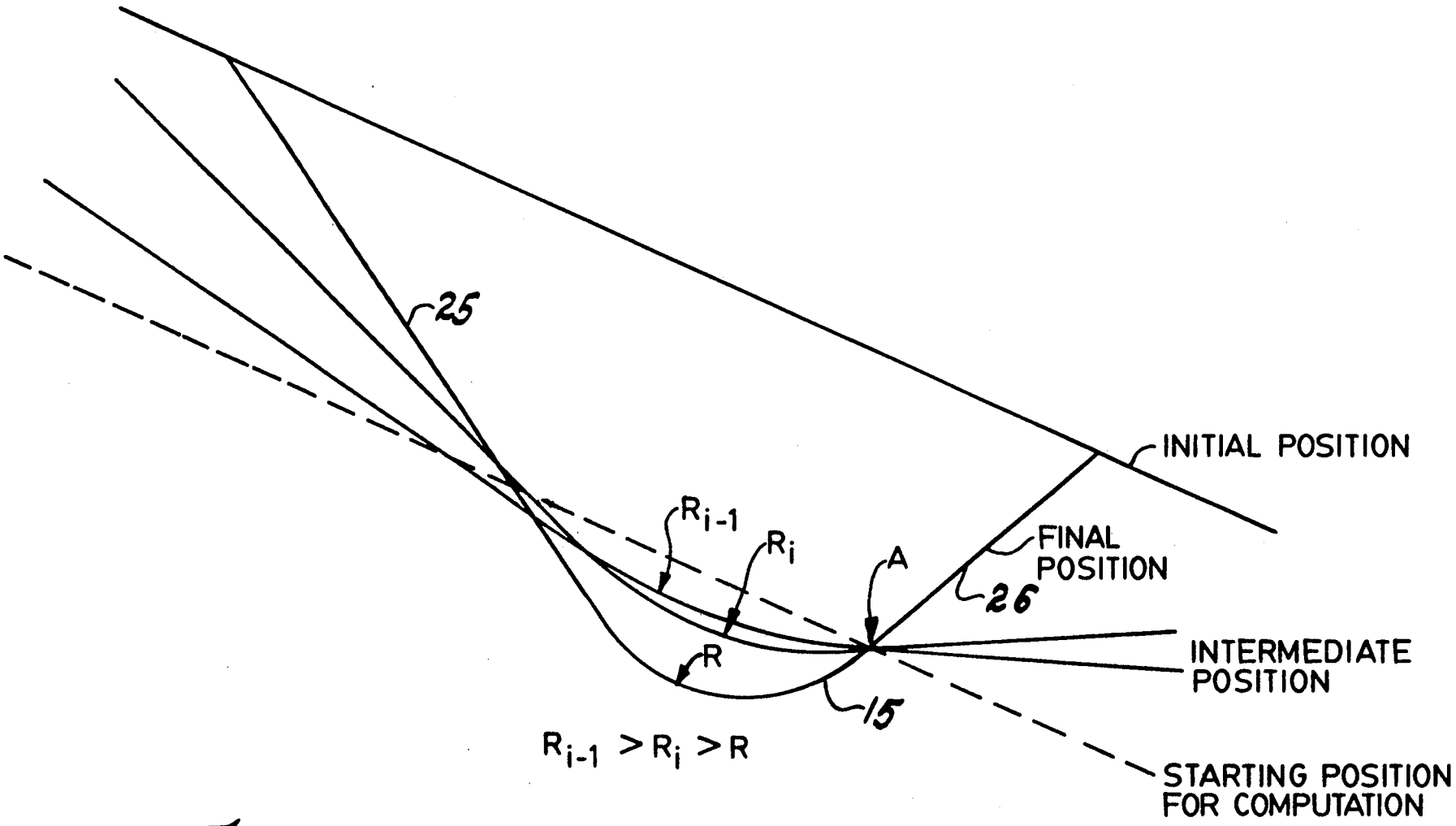
FIG. 5 is a schematic representation of a single arc segment utilized to define an arc set along one side having the greatest curvature.

Boundary conditions for the two opposite sides 13, 14 or edges of the blank 10 outline having the greatest curvature, when binder wrapped, are developed by hypothetically incrementally bending the panel from a known flat condition to the binder wrapped condition while controlling each arc set 42, 43 to pass through a fixed point A, called the anchor point, as it is changed in radius. To do this, the sides 13, 14 with the greatest curvature are projected onto artificial planes 18, 19, as shown in FIG. 6. Within such projection planes 18, 19, the panel is first transposed to a parallel artificial position passing through a selected fixed point A. The point A is selected with judgment to allow the panel to be contoured to the binder wrap configuration without excessive vertical displacement. In this artificial condition, the panel is then incrementally bent to a binder wrapped condition which define coordinates at straight and circular arc segments 15 along such side in the projection plane (see FIGS. 5 and 6). If the side is a composite of curves, additional circular arc segments are used for such curves, but point A remains the same for all the segments or curves. The circular arc segment 15 forms an arc set in conjunction with two straight line segments 25, 26. Each arc set has an anchor point A which coincides with the end point of the circular arc 10. The line joining the anchor points A on the two arc sets is called the anchor line which is perpendicular to the arc planes. The purpose for an arc set, with a specified slope 28, passing the anchor point is that the sheet during the binder analysis is properly supported (without rigid body motion or over-constraint). The specified slope 28 is equal to the tipping angle of the sheet at its initial position on the binder surface. An arc set containing only one circular arc is utilized in FIGS. 5 and 7; two tangent lines 11 and 12 are illustrated as drawn to the circular arc with a radius R in a specified slope at a point P with the arc passing the anchor point A.

In the initial position of the sheet, the straight line FDEG is the intersection of the sheet at its initial position with one of the arc set planes. For convenience in computation, it is translated to F'G' passing the anchor point A and the bending process is started from this position. At an intermediate position (i − 1), circular arc $B_{i-1}P_{i-1}A$ has a radius $R_{1-1}$ and the tangent at the point $P_{i-1}$ is parallel to FG. Two tangent lines are $D_{1-1}B_{1-1}$ and $AE_{1-1}$. Note that the arc passes the anchor point A and the arc length does not change.

From the intermediate position to a more advanced intermediate position, the circular arc will have a radius $R_i$. A circular arc $B'_iP_{i-1}A'_i$ with radius $R_i$ is drawn in its center $O'_i$ lies on the line $O_{i-1}P_{i-1}$. Therefore, the tangent to the circular arc with a radius $R_i$ at the point $P_{i-1}$ is parallel to FG. We then translate (without any rotation) the arc $B'_{i-1}P_{i-1}A'_i$ to $B_iP_iA_i$ so that it passes the fixed point A and the tangent at $P_i$ is still parallel to FG. Note that the center of the circular arc is translated from $O'_1$ to $O_i$ which determines $\overline{X}_o$ and $\overline{Z}_o$. Two tangent lines $D_iB_i$ and $AE_i$ can be drawn and $D_iB_i$ which is equal to DB and $AE_i$ which is equal to AE. At any intermediate step, the equation for a circular arc is:

$$(X_{i-1}-X_o)^2+(Z_{i-1}-Z_o)^2=(R_{i-1})^2$$

At the subsequent step it becomes $$(X_i-\overline{X}_o)^2+(Z_i-\overline{Z}_o)^2=(R_i)^2$$

where $X_o$ and $\overline{Z}_o$ are so determined that the arc passes a fixed point and the slope at a point on the arc is specified. Thus, the increment displacement boundary condition is:

$$\Delta Z=Z_i-Z_{i-1}$$

For sure convergence of the numerical solution in each incremental step, ΔZ is not allowed to be greater than a specified value, such as two inches.

Figure 7:
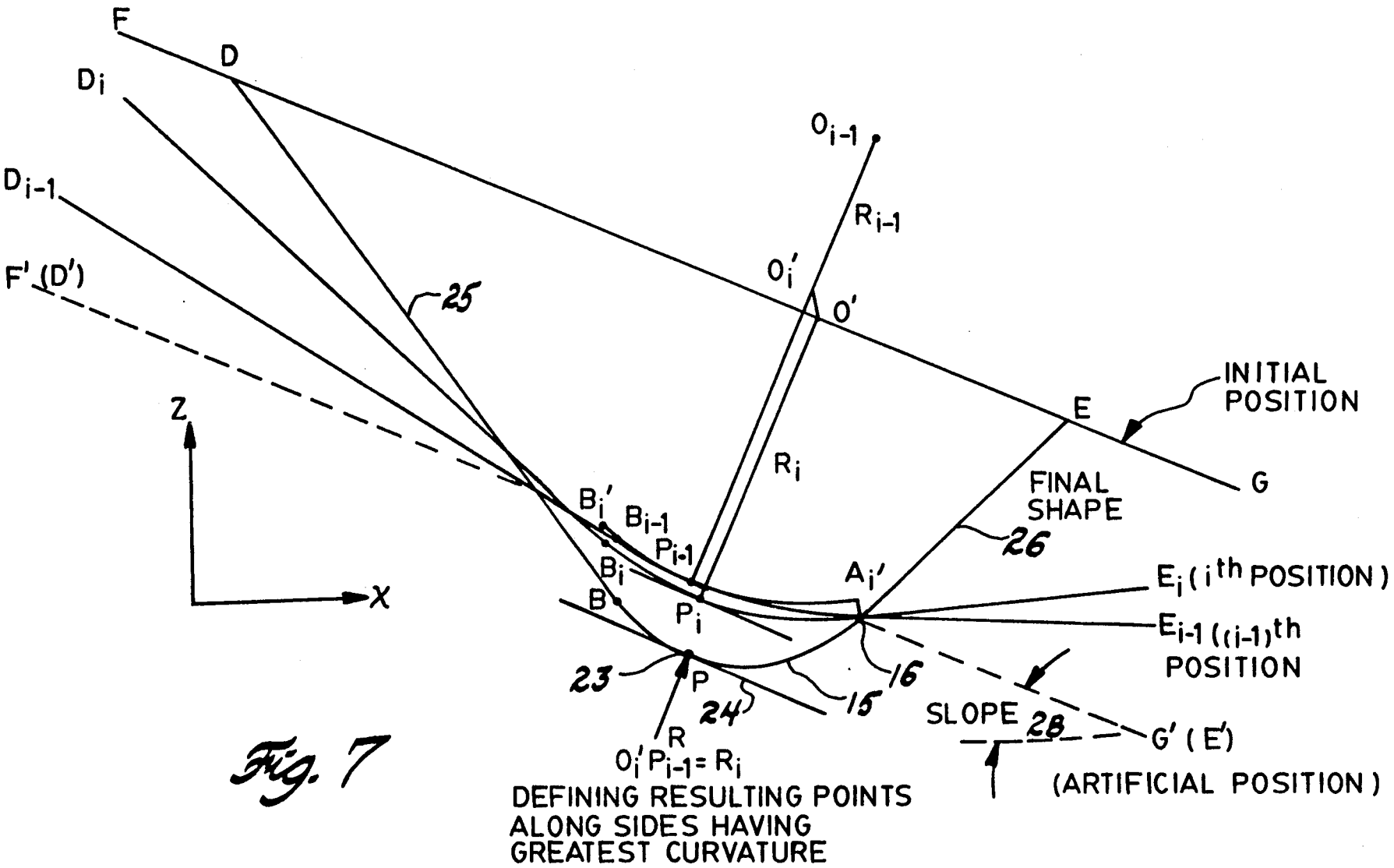
FIG. 7 is an enlarged view of two straight line segments and one arc segment illustrating intermediate positions of bending of such segment.

Thus, as shown in FIG. 7, the arc will proceed from an initial position with an infinite radius (straight line), to $R_{i-1}$, to $R_i$, to R of a final position.

FIG. 8 shows the method for determining the gap 45 or interference between the binder surface 32 and the points on sides 30, 31 of the blank outline 10 having the least curvature. Such sides are forced to lie on the binder surface 11 by proportionally reducing the gap 45 or interference during the bending process illustrated as follows. The boundary condition for a point $A_r$ on the edge of the rolled surface, the least curved side of the blank outline 10, is $\Delta Z = Z_b - Z_r$ where $Z_b$ is the Z coordinate of the point $A_b$ on the binder surface with the same X and Y coordinates as those of the point $A_r$. We use n steps in the bending process to reach the final shape; therefore, we impose $\Delta Z/n$ as the incremental boundary condition for each step at a point on the edge with less curvature, as shown in FIG. 8.

The deformed shape, according to step (c), comprises determining the displacement increments at nodes of segments into which the blank, including the suspended panel portion, is divided (see FIG. 9). This determination may be carried out by solving a boundary value problem in incremental steps because of the nonlinear characteristics of large deflections of the panel. The incremental displacement boundary conditions for points on the blank outline are established following steps (b) and (c) and the incremental force is due to the weight of the panel. The boundary value problem is formulated based on the nonlinear shell theory, and the finite element method is used to compute the deformation inside the punch opening line. In the shell theory, the metal sheet is modeled as a thin shell structure. The undeformed metal surface of the shell becomes the reference surface. With the thin shell assumption, the state of stress is approximately planar, i.e., the effects of transverse shear stresses and normal stress acting on the reference surface may be neglected. Using the shell theory, the three dimensional sheet may be represented by a surface (its middle surface). The strain at a point in the sheet is expressed:

$$\epsilon_{\alpha\beta} = \gamma_{\alpha\beta} + z\kappa_{\alpha\beta} \quad (\alpha,\beta = 1,2)$$

where $\gamma_{\alpha\beta}$ is the strain on the middle surface and $\kappa_{\alpha\beta}$ the curvature change of the middle surface and z the distance from the middle surface.

The undeformed middle surface is represented by $$x = x(\theta^\alpha)$$

$$(\alpha = 1,2)$$

The deformed middle surface is represented by $$\bar{x} = \bar{x}(\theta^\alpha),$$

$$\bar{x} = x + u$$

The middle surface strain is computed by $$\gamma_{\alpha\beta} = (\bar{a}_{\alpha\beta} - a_{\alpha\beta})/2$$

where $$a_{\alpha\beta} = \frac{\partial x}{\partial \theta^\alpha} \cdot \frac{\partial x}{\partial \theta^\beta}$$

and $\bar{a}_{\alpha\beta}$ is computed by the same equation except x is replace by $\bar{x}$. The curvature change is expressed by $$\kappa_{\alpha\beta} = -(\bar{b}_{\alpha\beta} - b_{\alpha\beta}) + (\text{correction due to stretching})$$

where $$b_{\alpha\beta} = n \cdot \frac{\partial^2 x}{\partial \theta^\alpha \partial \theta^\beta},$$

n is the normal to the middle surface and $\bar{b}_{\alpha\beta}$ is computed by the same equation except n replaced by $\bar{n}$ and x by $\bar{x}$. The stress increment is expressed by the stain increment:

$$\Delta\sigma^{\alpha\beta} = D^{\alpha\beta\xi\zeta}\Delta\epsilon_{\xi\zeta}$$

where D is the material tensor for the panel. Applying the principle of virtual work, one establishes the equlibrium for the current configuration as following:

$$\int_A \int_h \sigma^{\alpha\beta}\delta\epsilon_{\alpha\beta}\,dz\,dA = \int_A f^i \delta u_i\,dA$$

where the strain $\delta\epsilon_{\alpha\beta}$ is due to the virtual displacement $\delta u_i$, A is the total area of the panel surface, h is the deformed thickness, and $f^i$ is the weight of the panel per unit area of the surface.

The finite element method (displacement method), as mentioned earlier, is carried out by having the middle surface of a sheet subdivided into small elements, and in this case the elements are triangles 35. The vertices of the triangles are called nodal points 36, 37, 38 (nodes). Within each triangle 35, a deformed shape is assumed in terms of the displacements at its three nodes and displacement gradients. From the shell theory, the strains are expressed in terms of the node displacement; therefore, the stresses can be expressed in terms of the nodal displacements by using the stress/strain relationship. Using the equilibrium condition mentioned previously, an equilibrium equation for the panel is established:

$$\Delta K_t \Delta U = \Delta F$$

where $K_t$ is the tangent stiffness matrix and $\Delta F$ is the increment of the applied force due to weight of the panel. Note that the equilibrium equation is written in the incremental form because this is a nonlinear problem and a step-wise linearization process is used. A portion of the elements in the displacement incremental vector $\Delta U$ is known from steps (b) and (c); therefore, the rest of the elements in $\Delta U$ can be solved rather quickly because of rapid convergence of the method. Adding all of the displacement increments, the final shape of the panel inside the punch opening line is thus computed.

It is desirable that when an assumed final R is reached it be checked to see if it conforms with the binder surface; if not, all sides of the sheet are adjusted so that the panel will lie on the binder surface of the die. Again, using the nonlinear shell theory and the finite element method, the additional deformation due to the adjustment is carried out.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

I claim:

1. A method of rapidly determining a binder surface for a nonsymmetrical polygonal blank to be draw formed between a die having a draw opening and a punch insertable into such opening, comprising:

(a) forming a coordinate-based model of the blank with an outline;

(b) specifying the displacement boundary condition of the blank binder wrap shape by nonlinear theory of mechanics, including: (i) defining arc sets to fit projections of opposite sides of the blank outline, having the greatest curvature, onto arc planes while incrementally bending the blank from a known flat condition to a binder surface condition and controlling each arc set to pass through a fixed point as it is changed in radius, (ii) interpolating from said arc sets to generate points on such opposite sides having such greatest curvature and thus defining the binder surface for the blank outline along such sides, (iii) defining the binder surface for the blank outline along sides having the least curvature by forcing such sides to lie on the binder surface through the act of proportionally reducing the gap between said binder surface and the binder wrap of said sides having the least curvature during the bending process in step (b)(i); and (c) determining the deformed shape of said blank suspended inside said draw opening.

2. The method as in claim 1, in which the incremental bending of step (b)(i) is carried out by determining displacement increments at nodes of segments into which the panel is subdivided.

3. The method as in claim 2, in which said determination of displacement increments inside said draw opening is carried out by solving a boundary value problem using said displacement boundary conditions on all sides of said blank and using a force due to the weight of said blank.

4. The method as in claim 3, in which steps (b)(i) and (b)(iii) are simultaneously carried out.

5. The method as in claim 1, in which said method additionally comprises the step of adjusting all sides of said panel so that said blank portion lying outside of said draw opening is on the binder surface of the die and any deformation to the suspended panel portion conforming with such adjustment is made.

6. A method of rapidly determining a binder wrap for a nonsymmetrical polygonal panel to be draw formed, comprising:

(a) forming a coordinate-based model of the blank with an outline of said panel in terms of straight and circular arc segments, each circular arc having a center, radius, and arc angle;

(b) at coodrinate pairs along said outline and using said model, bending the panel from a flat condition to a binder surface condition by (i) incrementally changing the radius of segments on only the opposite edges of said blank outline which have the greatest curvature to define final resulting points at the ends of the arc segment which when combined defined the boundary of the binder wrapped panel, and (ii) proportionally reducing the gap between the binder surface and sides of the blank outline having the lesser curvature; and (c) determining the deformed shape of the portion of said blank suspended inside of said draw opening.

7. The method as in claim 6, in which step (c) is carried out by use of nonlinear shell theory and finite element analysis in which the sheet is represented by a set of nodal points and displacements are solved from force balance equations at each node for the finite element analysis.

8. A method of rapidly determining a binder wrap for a symmetrical polygonal blank to be draw formed between a die with a draw opening and a punch, comprising:

(a) forming a coordinate-based model of the blank with an outline and draw opening for said blank;

(b) defining resulting points at circular arc segments tangent to the outline of said draw opening by using arc sets to fit projections of opposite sides of the blank outline, having the greatest curvature, onto arc planes while incrementally bending the panel and controlling each arc set to pass through a fixed point at it is changed in radius;

(c) defining a binder surface for said blank outline along sides having the least curvature by forcing such sides to lie on said binder surface through the act of proportionally reducing the gap between the binder wrap and sides of the blank outline having the least curvature during the bending process of step (b); and (d) determining the deformed shape of said blank suspended inside said draw opening line.

* * * * *